US007591494B2

(12) United States Patent
Mitchell

(10) Patent No.: US 7,591,494 B2
(45) Date of Patent: Sep. 22, 2009

(54) WINDOW LOCK ASSEMBLY

(75) Inventor: Michael K. Mitchell, Rib Lake, WI (US)

(73) Assignee: Weather Shield Mfg., Inc., Medford, WI (US)

( * ) Notice: Subject to any disclaimer, the term of this patent is extended or adjusted under 35 U.S.C. 154(b) by 238 days.

(21) Appl. No.: 11/305,980

(22) Filed: Dec. 19, 2005

(65) Prior Publication Data

US 2007/0137111 A1 Jun. 21, 2007

(51) Int. Cl.
*E05B 63/20* (2006.01)

(52) U.S. Cl. ..... 292/336; 292/DIG. 47

(58) Field of Classification Search ..... 292/241, 292/242, 210, DIG. 20, DIG. 47, 336
See application file for complete search history.

(56) References Cited

U.S. PATENT DOCUMENTS 2,480,016 A * 8/1949 Granberg ..... 292/336
2,613,526 A * 10/1952 Holmsten ..... 70/90
2,846,258 A * 8/1958 Granberg ..... 292/336
4,014,572 A * 3/1977 Binns ..... 292/108
4,063,766 A * 12/1977 Granberg ..... 292/336
6,904,727 B2 6/2005 Edger
6,925,758 B2 8/2005 Pettit
2005/0115168 A1 6/2005 Bealko
2005/0121923 A1 6/2005 Lawrence
2005/0132532 A1 6/2005 Campbell et al.
2005/0151382 A1 7/2005 Barber

* cited by examiner

*Primary Examiner*—Gary Estermsky
(74) *Attorney, Agent, or Firm*—Price, Heneveld, Cooper, DeWitt & Litton, LLP

(57) ABSTRACT

A window latch assembly for locking first and second windows together includes a cover member coupled to the first window, and a handle pivotably coupled to the cover member. A lock member is fixedly coupled to the handle and has a lock portion adapted to protrude beyond a planar extent of the cover into a locked position, wherein the lock portion engages a lock keeper coupled to the second window, and an unlocked position, wherein the lock keeper is retracted inside the cover member. A mechanical finger is movable between a first position allowing the lock portion to be moved from the unlocked position to the locked position, and a second position preventing the lock portion from being moved from the unlocked position to the locked position, thereby preventing damage of the first and second windows.

16 Claims, 3 Drawing Sheets

WINDOW LOCK ASSEMBLY

BACKGROUND OF THE PRESENT INVENTION

The present invention relates to a lock mechanism for use within a window assembly, and in particular to a lock mechanism that prevents accidental damage to the window assembly during operation thereof.

Window assemblies and lock mechanisms for securing window assemblies, particularly single and double hung window sash assemblies, are used frequently in residential and commercial building structures. These lock mechanisms frequently include a deployable catch member that is operative between an engaged position and a disengaged position. The disengaged position allows a window assembly to be opened. The engaged position prohibits opening of the window assembly because the catch member is inserted into a lock keeper.

A commonly acknowledged shortcoming in the currently available designs of single and double hung window sash lock mechanisms is that the catch member can be rotated to the locked position when the sash are in an opened position. Specifically, former designs have allowed the catch member to be rotated to the locked position when the sash are in an opened position. When this occurs, the catch member extends outwardly from the associated sash and into the path of the remaining sash thereby causing damage to the remaining sash, lock, lock keeper, etc. when the sash are moved to the closed position.

Accordingly, a lock mechanism that prevents the catch member from moving into the locked position when the window assembly is open would be useful and an improvement in the art.

SUMMARY OF THE INVENTION

In one aspect of the present invention, a window latch includes a housing member having an interior and a handle operably coupled to the housing member wherein the handle is movable between an unlocked position and a locked position. A catch member is fixed for rotation with the handle and includes a first stop. The catch member rotates between a locked position corresponding to the locked position of the handle, wherein the catch member is adapted to engage a lock keeper thereby preventing movement of a first window with respect to a second window, and an unlocked position, corresponding to the unlocked position of the handle wherein the catch member is adapted to disengage a lock keeper, thereby allowing movement of the first window with respect to the second window. A lever is operably coupled to the housing and includes a second stop. The lever operates between a first position, wherein the second stop abuts the first stop preventing rotation of the catch member from the unlocked position to the locked position, and a second position, wherein the lever allows rotation of the catch member from the unlocked position to the locked position. The second stop is configured to allow rotation of the catch member from the locked position to the unlocked position when the lever is in the first position and when the lever is in the second position.

In another aspect of the present invention, a window assembly includes a first window including a first window sash and a second window that includes a second window sash substantially parallel with and movable relative to the first window sash. A lock mechanism is fixed to a select one of the first window sash and the second window sash, and a lock receiver is fixed to a select one of the first window sash and the second window sash not fixed to the lock mechanism.

The lock mechanism includes a lock member operating between a locked position, wherein the lock member engages the lock receiver preventing movement between the first and second windows, and an unlocked position allowing movement between the first and second windows. A bar member moves between a first position, wherein the bar member engages the lock mechanism preventing the lock mechanism from being moved from the unlocked position to the locked position, and a second position allowing the lock mechanism to be moved from the unlocked to the locked position.

In yet another aspect of the present invention, a window latch assembly includes a cover member and a handle pivotably coupled to the cover member. A lock member is fixed for rotation with the handle and has a lock portion adapted to protrude beyond a planar extent of the cover into a first position and retract inside the cover into a second position. The lock keeper is also adapted to securely engage a complementary lock keeper. A mechanical finger is movable between a first position allowing the lock portion to be moved from the second position to the first position, and a second position preventing the lock portion from being moved from the second position to the first position.

The present inventive window latch comprises an uncomplicated design, is quickly and easily assembled during manufacture, is relatively economical to manufacture, is capable of a long operating life, and is well adapted for the proposed use. Specifically, the window latch allows normal operation of a window assembly while preventing accidental damage to the components thereof by an outwardly extended catch or lock member.

These and other features, advantages and objects of the present invention will be further understood and appreciated by those skilled in the art upon studying the following specification, claims, and appended drawings.

DETAILED DESCRIPTION OF PREFERRED EMBODIMENTS

Figure 2A:
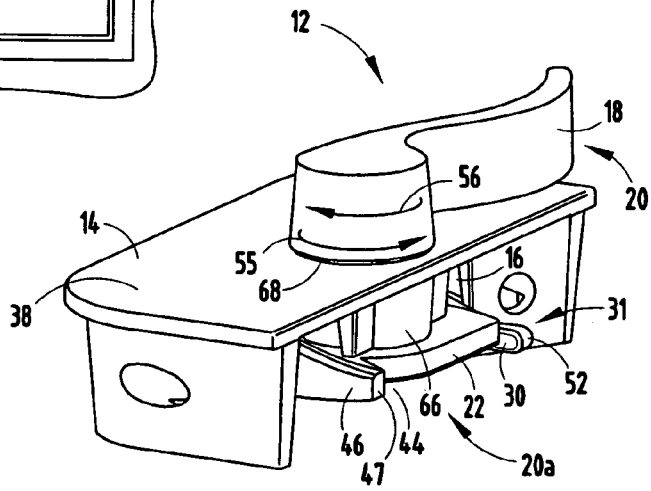
FIG. 2A is a top and side perspective view of the window latch in an unlocked position.
Figure 2B:
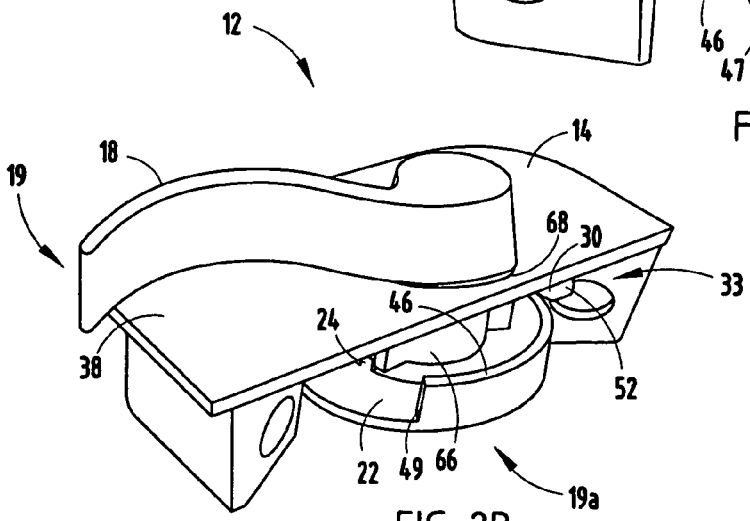
FIG. 2B is a top and side perspective view of the window latch in a locked position.
Figure 2:
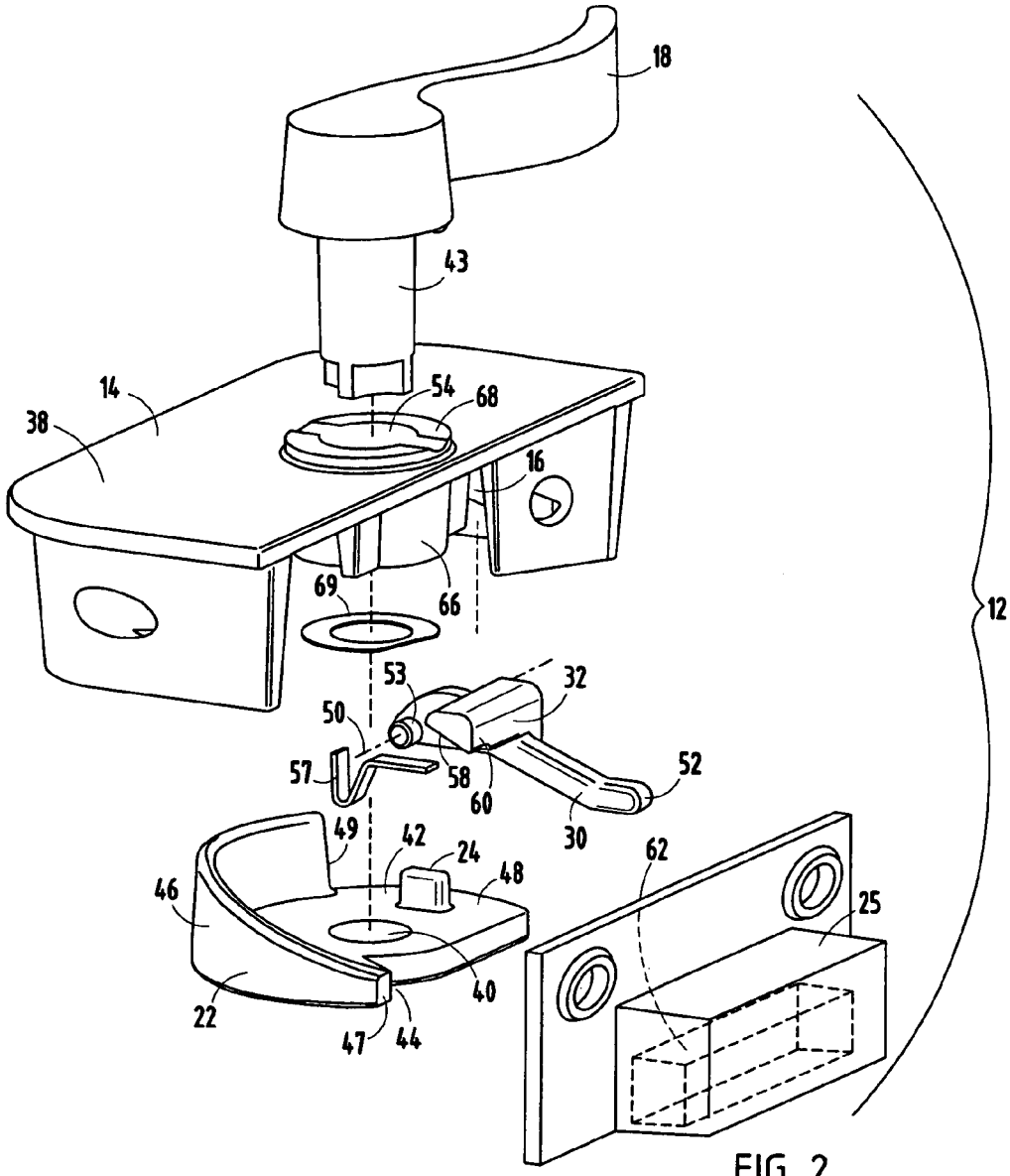
FIG. 2 is an enlarged, exploded, top and side perspective view of a window latch.

For purposes of description herein the terms "upper", "lower", "right", "left", "rear", "front", "vertical", "horizontal" and derivatives thereof shall relate to the invention as oriented in FIG. 2. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
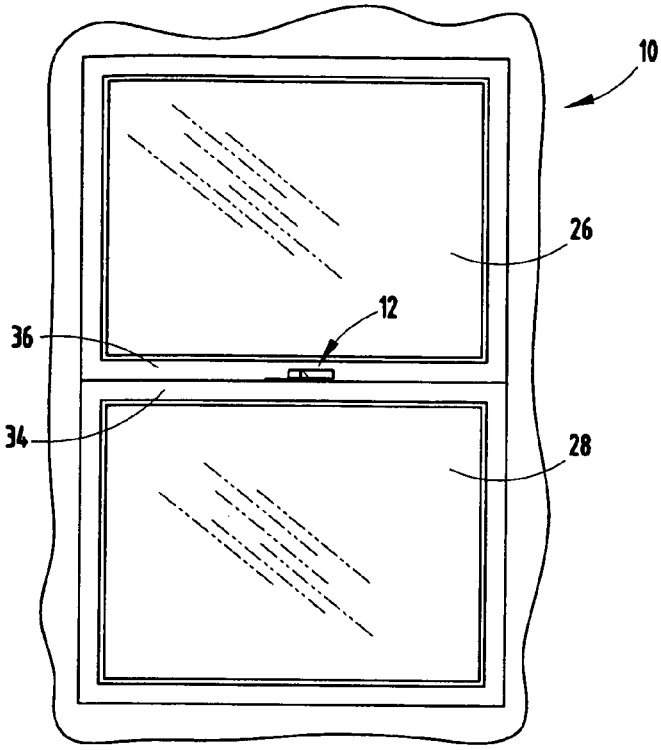
FIG. 1 is a front elevational view of a window assembly embodying the present invention.
Figure 3:
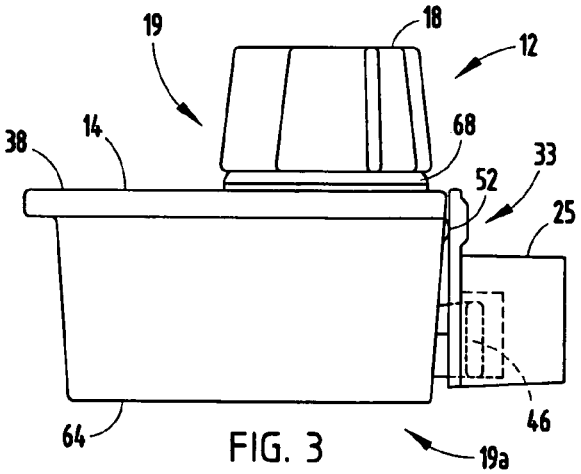
FIG. 3 is a side elevational view of the window latch in the locked position.

The reference numeral 10 (FIG. 1) generally designates a window assembly embodying the present invention, which is designed for use in a building structure (not shown). The window assembly 10 has a window latch 12 (FIGS. 2 and 3) that includes a housing member 14 having an interior 16 and a handle 18 pivotably coupled to the housing member 14 wherein the handle 18 is movable between a locked position 19 (FIG. 2B) and an unlocked position 20 (FIG. 2A). A catch member 22 is fixedly coupled with the handle 18 and includes a first stop 24. The catch member 22 rotates between a locked position 19*a* corresponding to the locked position 19 of the handle 18 and wherein the catch member 22 is adapted to engage a lock keeper 25 thereby preventing movement of a first window 26 with respect to a second window 28, and an unlocked position 20*a,* corresponding to the unlocked position 20 of the handle 18 and wherein the catch member 22 is adapted to disengage the lock keeper 25, thereby allowing movement of the first window 26 with respect to the second window 28. A lever 30 is pivotably coupled to the housing member 14 and includes a second stop 32. The lever 30 operates between a first position 31, wherein the second stop 32 abuts the first stop 24 preventing rotation of the catch member 22 from the unlocked position 20*a* to the locked position 19*a,* and a second position 33, wherein the lever 30 allows rotation of the catch member 22 from the unlocked position 20*a* to the locked position 19*a,* and wherein the second stop 32 is configured to allow rotation of the catch member 22 from the locked position 19*a* to the unlocked position 20*a* when the lever 30 is in the first position 31 and when the lever 30 is in the second position 33.

In the illustrated example, the catch member 22 is secured to a top portion 34 of the second window 28 and adapted to engage the lock keeper 25 secured to a bottom portion 36 of the first window 26. Alternatively, the catch member 22 may be secured to the bottom portion 36 of the first window 26 such that it engages the lock keeper 25 secured to the top portion 34 of the second window 28.

As best illustrated in FIGS. 2, 2A, and 2B, the handle 18 rotates on a top surface 38 of the housing member 14 causing rotation of the catch member 22 into and out of the locked and unlocked positions 19*a,* 20*a*. Specifically, an aperture 40 extends through a center portion 42 of the catch member 22 and receives a pivot rod 43 therein that is secured to the handle 18, thereby coupling the handle 18 for rotation with the catch member 22.

The catch member 22 includes an indent 44 located adjacent to a retaining flange 46. The first stop 24 is disposed on an open side 48 of the catch member 22 opposite from the retaining flange 46. The arcuately shaped retaining flange 46 slopes upwardly between opposite ends 47, 49 thereof.

The lever 30 is located within the interior 16 of the housing 14 adjacent to the catch member 22 and pivots about a pivot axis 50 as defined by a pair of pivot bosses 53. The lever 30 is rotatable between the first position 31 and the second position 33 in a plane perpendicular to a plane in which the handle 18 rotates. When the lever 30 is in the first position, the second stop 32 abuts the first stop 24. A distal end 52 of the lever 30 is rotated upward into the second position 33 when the window assembly 10 is opened, as further explained below. Rotation of the lever 30 moves the second stop 32 out of interference with the first stop 24, thereby allowing the handle 18 to rotate the catch member 22. In the illustrated example, the handle 18 generally turns approximately 180 degrees in the direction of arrow 55 into the locked position 19 and in the direction of arrow 56 in the unlocked position 20.

In the event that the lever 30 is moved to the first position 31 when the catch member 22 is in the locked position 19*a,* the handle 18 and catch member 22 may be rotated to raise the lever 30 into the second position 33. As illustrated, a biasing force is exerted on the lever 30 by a spring member 57 forcing the lever 30 towards the first position 31. Alternatively, the force exerted on the lever 30 may be a gravitational force, or a combination of the gravitational force and the spring force. During rotation of the catch member 22, the first stop 24 contacts an angled back portion 58 of the second stop 32 of the lever 30. When a force applied by a user on the handle 18 is greater than the force from the spring member 57, the angled back portion 58 of the second stop 32 and the entire lever 30 is raised until the first stop 24 clears an abutting face 60 of the second stop 32. The first stop 24 is no longer in contact with the angled back portion 58 of the second stop 32 once the first stop 24 clears the abutting face 60 of the second stop 32, thereby allowing the spring member 57 to force the lever 30 back to the first position 31. Accordingly, the catch member 22 cannot rotate from the unlocked position 20*a* to the locked position 19*a* because the abutting face 60 of the second stop 32 is in interference with the first stop 24.

In operation, the catch member 22 (FIG. 3) rotates out of the housing member 14 to engage the lock keeper 25. The retaining flange 46 of the catch member 22 secures a complementary receiver 62 in the lock keeper 25. The handle 18 and the catch member 22 are prevented from rotating further once the retaining flange 46 is fully secured in the lock keeper 25.

Figure 4:
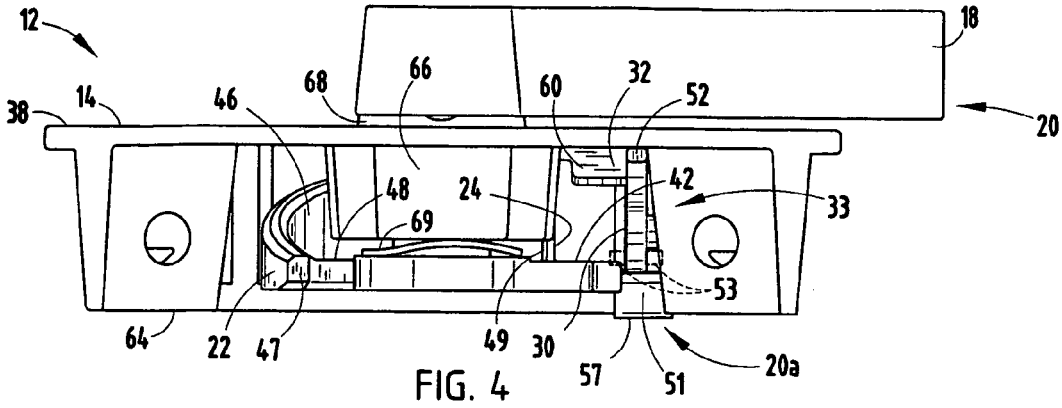
FIG. 4 is a front elevational view of the window latch including a raised lever.

The catch member 22 of the window latch 12, as illustrated in FIG. 4, is in the unlocked position 20*a* with the lever 30 in the second position 33. The catch member 22 is positioned inside the housing member 14 and above a planar extent of a bottom portion 64 of the window latch 12. The catch member 22 is secured to the pivot rod 43 which is received by a sleeve 66 of the catch member 22. A collar 68 is disposed around the pivot rod 43, between the top surface 38 of the housing member 14 and the handle 18. A frictional washer 69 disposed below the collar 68 creates frictional resistance that impedes movement of the handle 18 out of the unlocked position 20 and out of the locked position 19. This frictional resistance minimizes the likelihood that the handle 18 will rotate the pivot rod 43 in the sleeve 66 without force applied by a user.

Figure 5:
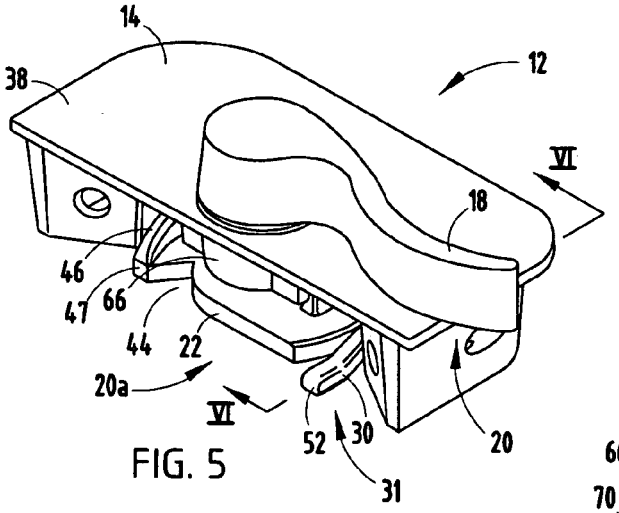
FIG. 5 is a top and opposite side perspective view of the window latch.
Figure 6:
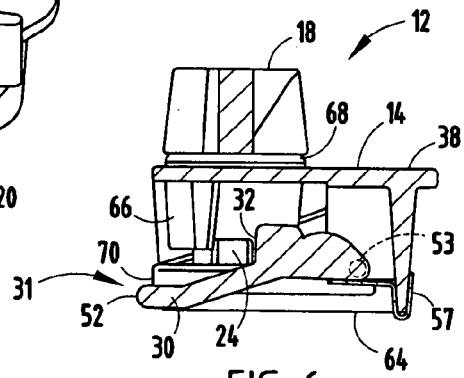
FIG. 6 is a cross-sectional view of the window latch taken at line VI-VI, FIG. 5.

The catch member 22 of the window latch 12, as illustrated in FIGS. 5 and 6, is in the unlocked position 20*a* with the lever 30 in the first position 31. The window latch 12 will generally have this arrangement when the lock keeper 25 is not adjacent to the housing member 14, i.e., when the window assembly 10 is open. Further, in this position, the first stop 24 is aligned with the second stop 32 and prevents rotation of the handle 18. The distal end 52 of the lever 30 protrudes beyond a vertical planar extent 70 of the housing member 14 when the lever 30 is in the first position 31. The lock keeper 25 abuts the distal end 52 of the lever 30 forcing the lever 30 to pivot upward about the pivot axis 50 disposed on the inside portion of the housing member 14 when the window assembly 10 is closed by a user.

Figure 7:
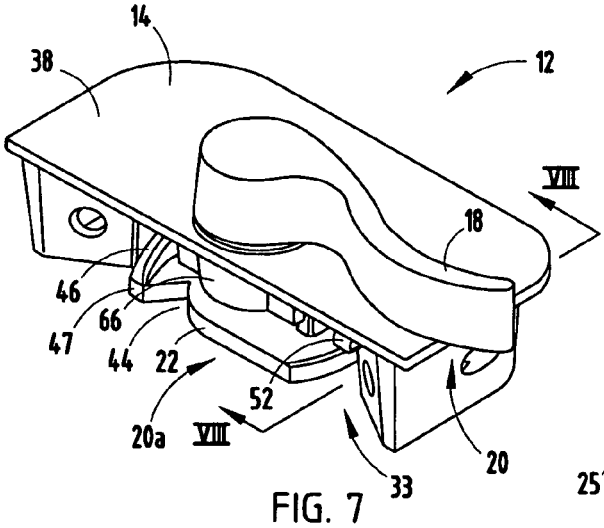
FIG. 7 is a top and opposite side perspective view of the window latch including a raised lever.
Figure 8:
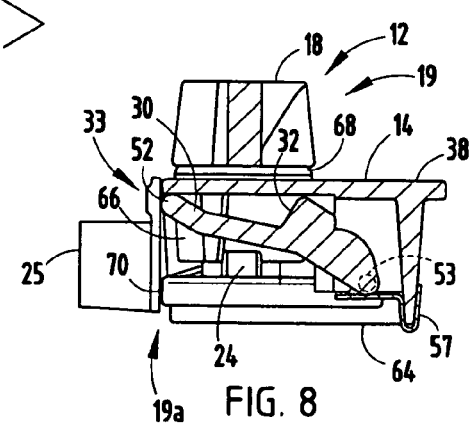
FIG. 8 is a cross-sectional view of the window latch taken at line VIII-VIII, FIG. 7.

The catch member 22 of the window latch 12, as illustrated in FIGS. 7 and 8, is in the unlocked position 20*a* with the lever 30 in the second position 33. The window latch 12 will generally have this arrangement when the lock keeper 25 is adjacent to the window latch 12, i.e., when the window assembly 10 is closed. In this position, the second stop 32 has been rotated vertically out of interference with the first stop 24, thereby allowing rotation of the catch member 22. The distal end 52 of the lever 30 does not protrude beyond the vertical planar extent 70 of the housing member 14 when the lever 30 is in the second position 33.

The above description is considered that of the preferred embodiments only. Modifications of the invention will occur to those skilled in the art and to those who make or use the invention. Therefore, it is understood that the embodiments shown in the drawings and described above is merely for illustrative purposes and not intended to limit the scope of the invention, which is defined by the following claims as interpreted according to the principles of patent law, including the Doctrine of Equivalents.

The invention claimed is:

1. A window latch comprising:

a housing member having an interior and adapted for mounting on a first window of a double hung window set;

a handle operably coupled to the housing member wherein the handle is movable between an unlocked position and a locked position;

a catch member substantially disposed in the housing and fixed for rotation with the handle, the catch member including a first stop, the catch member rotating between a extended position corresponding to the locked position of the handle, wherein the catch member is adapted to engage a lock keeper mounted on the second window in the set, when the lock keeper is adjacent the housing member, thereby preventing movement of the first window with respect to the second window, and a retracted position, corresponding to the unlocked position of the handle wherein the catch member is adapted to disengage the lock keeper, thereby allowing movement of the first window with respect to the second window;

a lever operably coupled with and disposed substantially inside the interior of the housing member and including a second stop with an abutting face and an angled back portion, wherein the abutting face contacts the first stop preventing the catch member from entering the extended position when the housing member is not adjacent to the lock keeper and wherein the first stop contacts and displaces the angled back portion during rotation of the catch member from the extended position to the retracted position when the housing member is not adjacent to the lock keeper.

2. The window latch of claim 1, wherein the lever is pivotably coupled to the housing member and wherein the lever rotates in a plane perpendicular to a plane in which the handle rotates.

3. The window latch of claim 1, wherein the lever has a distal end that protrudes beyond a planar extent of a face of the housing when the lever is in the first position.

4. The window latch of claim 3, wherein the distal end of the lever is adapted to abut a lock keeper.

5. The window latch of claim 1, wherein the lever is spring-biased.

6. The window latch of claim 1, further including:

a pivot rod fixedly coupling the handle with the catch member, and pivotably received within an aperture extending through the housing.

7. A window assembly comprising:

a housing;

a first window including a first window sash;

a second window including a second window sash substantially parallel with and movable relative to the first window sash;

a freely-rotating non-biased lock mechanism substantially disposed in the housing and operably coupled with a select one of the first window sash and the second window sash and a lock receiver fixed to a select one of the first window sash and the second window sash not fixed to the lock mechanism, the lock mechanism including a lock member with a first stop, the lock member operating between a locked position, wherein the lock member engages the lock receiver preventing movement between the first and second windows, and an unlocked position allowing movement between the first and second windows; and a lever disposed substantially inside the housing and having a second stop with an abutting face and an angled back portion, the lever being movable between an interference position wherein a distal end of the lever contacts the housing and the abutting face contacts the first stop thereby preventing rotation of the lock mechanism and a non-interference position, the lever capable of being placed in the raised non-interference position wherein the distal end of the lever does not contact the housing as a result of the first stop on the lock member contacting and rotating the angled back portion and lever upward.

8. The window assembly of claim 7, wherein the lock mechanism further includes a housing and wherein the lever is pivotably coupled to the housing.

9. The window assembly of claim 7, wherein the distal end of the lever is adapted to abut the lock receiver.

10. The window latch of claim 7, wherein the lever is spring-biased towards the interference position.

11. A window latch assembly comprising:

a housing;

a handle pivotably coupled to the housing;

a freely-rotating non-biased lock member partially disposed in the housing with a first stop and fixed for rotation with the handle and further having a lock portion adapted to protrude beyond the housing into an extended position and retract inside the housing into a retracted position, and adapted to securely engage a complementary lock keeper; and a lever disposed in the housing and having a distal end and a second stop with an abutting face and an angled back portion, the lever being movable between an interference position wherein the abutting face contacts the first stop thereby preventing rotation of the lock mechanism and a non-interference position wherein the distal end of the lever is in abutting contact with the housing, the lever capable of being placed in the non-interference position as a result of the first stop on the lock member contacting and moving the angled back portion upward.

12. The window latch of claim 11, wherein the lever is pivotably coupled to the housing and wherein the lever rotates in a plane perpendicular to a plane in which the handle rotates.

13. The window latch of claim 11, wherein the lever has a distal end that protrudes beyond a planar extent of a face of the housing when the lever is in the second position.

14. The window latch of claim 13, wherein the distal end of the lever is adapted to abut the lock keeper.

15. The window latch of claim 11, wherein the lever is spring-biased.

16. The window latch of claim 11, further including:

a pivot rod fixedly coupling the handle with the lock portion, and pivotably received within an aperture extending through the housing.

* * * * *